US006926391B2

(12) United States Patent
Yang et al.

(10) Patent No.: US 6,926,391 B2
(45) Date of Patent: Aug. 9, 2005

(54) MICRO FLUIDIC MODULE

(75) Inventors: Jinn-Cherng Yang, Hsinchu Hsien (TW); Ching-Yi Mao, Hsinchu Hsien (TW); Chou-Lin Wu, Hsinchu Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 17 days.

(21) Appl. No.: 10/601,620

(22) Filed: Jun. 24, 2003

(65) Prior Publication Data

US 2004/0125175 A1 Jul. 1, 2004

(30) Foreign Application Priority Data

Dec. 30, 2002 (TW) ..... 91137908 A

(51) Int. Cl.[7] ..... B41J 2/05
(52) U.S. Cl. ..... 347/65
(58) Field of Search ..... 347/65, 61, 62, 347/63, 64, 67, 68, 69, 70, 71, 72, 54, 1, 5, 7, 9, 20

(56) References Cited

U.S. PATENT DOCUMENTS 6,042,222 A 3/2000 Moritz, III et al.

*Primary Examiner*—Raquel Y. Gordon
(74) *Attorney, Agent, or Firm*—Birch, Stewart, Kolasch & Birch, LLP

(57) ABSTRACT

A micro fluidic module having at least a micro fluid channel barrier comprises at least an actuator, a firing chamber, a plurality of convergent fluid outlet channel and a plurality of convergent fluid inlet channel. The actuator (e.g. a heater) boils the working fluid and generates thermal bubble and instant high pressure to eject the working fluid outside and expel the working fluid through the fluid outlet channel. Then, the working fluid refills from the fluid inlet channel. Therefore, the working fluid flows consistently through the firing chamber. The working fluid flowing through adjacent firing chambers are arranged in different or consistent directions. Therefore, the refilling speed of the working fluid is increased, and the operating frequency of the module is improved.

19 Claims, 8 Drawing Sheets

MICRO FLUIDIC MODULE

This nonprovisional application claims priority under 35 U.S.C. § 119(a) on Patent Application No(s). 091137908 filed in TAIWAN, R.O.C. on Dec. 30, 2002, which is (are) herein incorporated by reference.

BACKGROUND OF THE INVENTION

1. Field of the Invention

The invention generally relates to a micro fluidic module applicable to micro-electromechanical devices, and particularly relates to a micro fluidic module having a consistent fluid flow.

2. Related Art

New technologies are fast developed and greatly facilitate the convenience of modern livings. Developments of micro electromechanical systems are especially a trend of new electronic and mechanical devices. In accompany with developments in semiconductor and information electronic industries, electronic products are getting lighter, thinner, shorter and smaller. The components and manufacturing facilities are also getting more tiny and precise. The manufacturing technologies are aiming at high precision, high density, high speed, intelligence and micro-miniature. The "next generation manufacturing technology" for the new century industries mainly includes two aspects. They are nano technology and micro electromechanical systems (MEMS). The fore one is the technology for manufacturing in the range of $10^2$ nm~$10^{-1}$ nm; the next is to apply nano technology for making microelements and components and integrating systems with microelectronic circuits and controllers.

In the micro fluidic technology, common-used micro fluidic devices, such as ink jet print head, injector or other injection elements and applications are getting more and more important. As shown in FIG. 1A, a conventional micro fluidic channel element includes an ejection chamber 15 connected to a single channel 13 formed on a barrier 12. A heater boils the working fluid inside the chamber 15 and generates thermal bubble. The instant high pressure of the thermal bubble ejects a part of the working fluid outside through an unshown ejection nozzle and a part through the channel 13. After the thermal bubble dissipates, some working fluid provided by a reservoir 14 fills into the chamber 15 through the channel 13. So, the working fluid flows in two directions through the channel 13 that it comes out when ejection, and goes in when refilling.

As shown in FIG. 1B, a conventional micro fluid channel array, as disclosed by U.S. Pat. No. 6,042,222, includes several ejection chambers and channels. When any a chamber being activated by a heater 11 to eject working fluid out through the channel 13, the working fluid in the adjacent chambers 15 and channels 13 are interfered by fluidic "cross talk" that retards the refilling of the working fluid. The operating frequency of the channel is therefore hard to be increased. During the ejection process and refilling stage, the flows of working fluid are in opposite directions, the fluidic resistance slows the refilling and seriously influences the operating frequency of the ejector.

SUMMARY OF THE INVENTION

The object of the invention is to solve the aforesaid problem and provide a micro fluidic module utilizing consistent micro fluid channels and sequential driving for guiding the flow of working fluid.

A micro fluidic module according to the invention includes a plurality of micro fluidic units. Each micro fluidic unit includes a micro fluid channel barrier, a firing chamber, an actuator and at least a convergent fluid outlet channel and at least a convergent fluid inlet channel. The firing chamber is formed on the micro fluid channel barrier and capable of storing working fluid. The actuator, such as a heater, is mounted inside the firing chamber for boiling the working fluid and generating thermal bubble. The fluid outlet channel and the fluid inlet channel are formed on two sides of the micro fluid channel barrier. Each channel is specially formed into a convergent shape that one end has a wider section and the other end has a narrower section so that the working fluid easily enters from the wider end and exits from the narrower end. Therefore, a micro fluid channel is arranged on one side of the firing chamber in a direction to let working fluid easily flow into the firing chamber and to prevent flowing out. That makes an inlet channel. In reverse, another micro fluid channel is arranged on the other side of the firing chamber in an opposite direction to let working flow easily flow out from the firing chamber and to prevent flowing in. That makes an outlet channel. The convergent channel thus provides a one-way flow characteristic. When the instant high pressure of working fluid thermal bubble is generated by the actuator, a part of working fluid ejects outside; and the rest of working fluid flows outwards through the outlet channel. After the thermal bubble dissipates, working fluid is refilled into the firing chamber through the inlet channel. Accordingly, the working fluid in the firing chamber flows consistently.

In the micro fluidic module of the invention, the working fluid in adjacent firing chambers are arranged to have opposite flow directions so that the entire serial micro fluidic units provide an S-shape flow direction. Further, adjacent actuators of the micro fluidic units are driven with different sequences to prevent cross-talk interference of the working fluid. Therefore, the refilling speed of the working fluid is increased, and the operating frequency of the module is improved.

The convergent micro fluid inlet channel and micro fluid outlet channel in a fluidic module of the invention make the working fluid flow in consistent directions. According to different requirements, the micro fluid channel barrier can be arranged into different shapes; and multiple fluid inlet channels and multiple fluid outlet channels can be used. The variant arrangements provide different kinds of flow directions. In accompany with sequential driving of adjacent actuators of the micro fluid units, the cross-talk of working fluid is prevented. The refilling speed of working fluid and the system operating frequency are increased accordingly.

BRIEF DESCRIPTION OF THE DRAWINGS

The invention will become more fully understood from the detailed description given hereinbelow. However, this description is for purposes of illustration only, and thus is not limitative of the invention, wherein.

DETAILED DESCRIPTION OF THE INVENTION

The micro fluidic module of the invention is applicable to manufacturing of micro-electromechanical devices. The alternative flow directions and sequential operation of activators make the micro fluidic module a high efficient micro ejector.

Figure 1A:
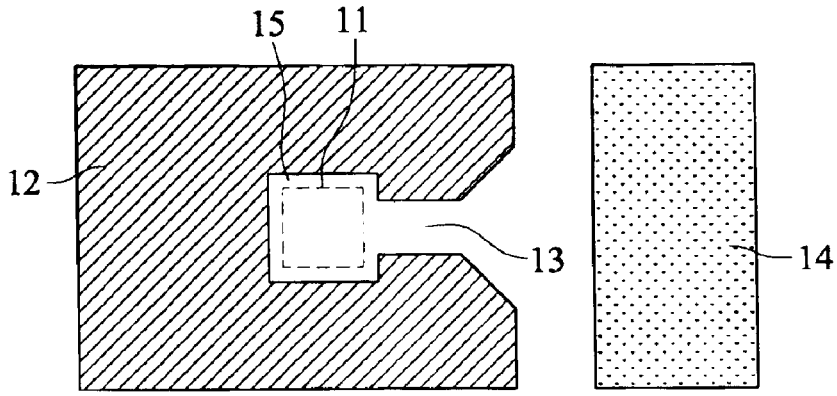
FIG. 1A is a constructional view of a conventional micro fluidic channel element.
Figure 1B:
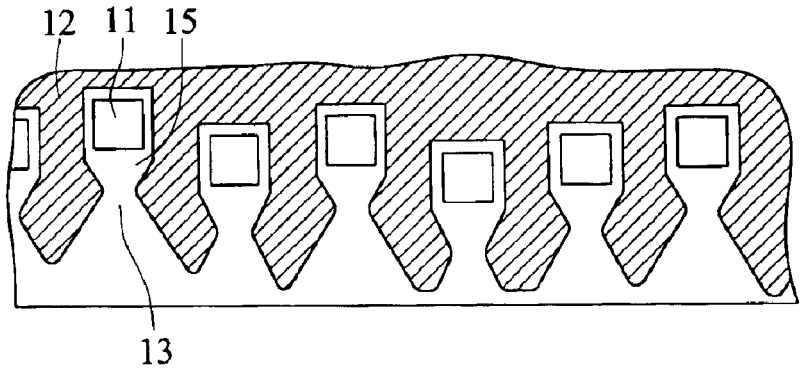
FIG. 1B is a constructional view of a conventional micro fluidic channel array.
Figure 2:
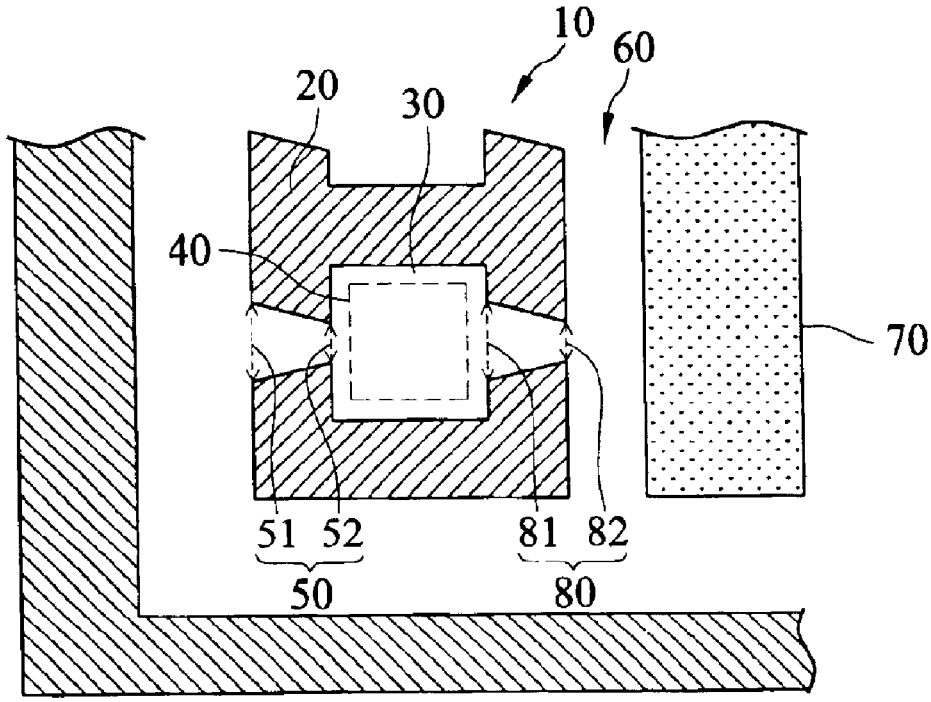
FIG. 2 is a constructional view of a micro fluidic unit in a first embodiment of a micro fluidic module according to the invention.

A micro fluidic channel element 10 as shown in FIG. 2, which composes a micro fluidic module as a first embodiment of the invention, includes a micro fluid channel barrier 20 and a firing chamber 30. The firing chamber 30 is formed inside the micro fluid channel barrier 20 for storing working fluid. An activator 40, mounted inside the firing chamber 30, for generating pressure by an electrical input. The activator 40 is usually a piezoelectric ceramic heater for heating the working fluid in the firing chamber 30. Two sides of the micro fluid channel barrier 20 are formed with a fluid inlet channel 50 and a fluid outlet channel 80 respectively. The fluid channels are all of convergent shapes that the left end (front end) 51 of the inlet channel 50 has a wider section, while the right end (rear end) 52 has a narrower section, so as to force working fluid flowing from the front end 51 through the rear end 52. Similarly, the left end (front end) 81 of the outlet channel 80 has a wider section, while the right end (rear end) 82 has a narrower section, so as to force working fluid flowing from the front end 81 through the rear end 82. The firing chamber 30 is connected with a working fluid passage 60, formed around the fluid channel barrier 20, via the fluid inlet channel 50 where the working fluid supplied by a working fluid reservoir 70 can easily flow into the firing chamber 30. The firing chamber 30 is also connected with the working fluid passage 60 via the fluid outlet channel 80 where the working fluid in the firing chamber 30 can flow outwards.

Figure 3A:
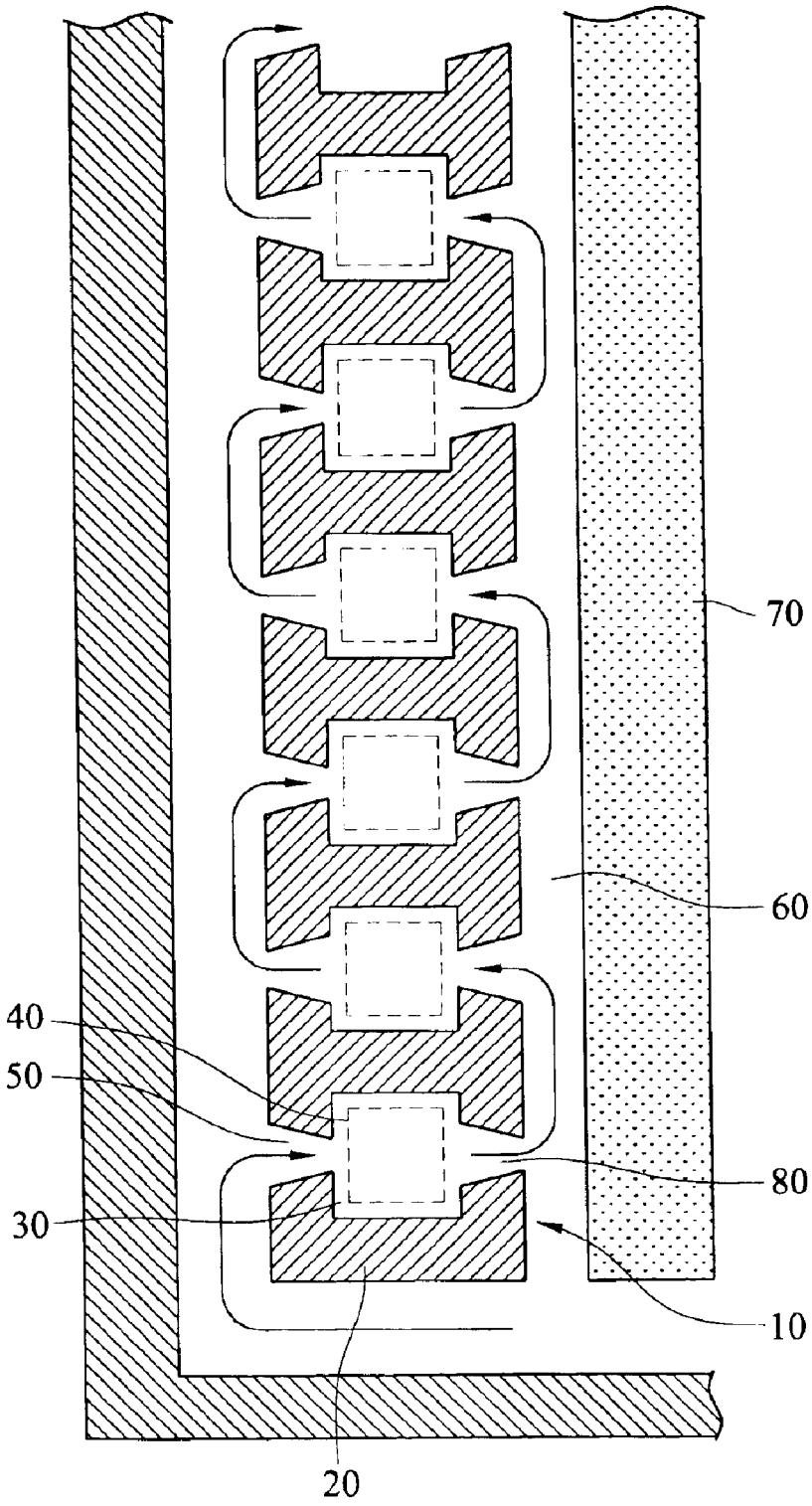
FIG. 3A is a working fluid flow direction illustration for a micro fluidic module of the invention.

Now referring to FIG. 3A, a micro fluidic module of the invention includes a plurality of micro fluidic channel elements 10. The actuator 40 in each element 10 provides thermal energy to the working fluid in the firing chamber 30, and generates thermal bubble and instant high pressure to eject a part of working fluid outside the nozzle (not shown in the drawing) and a part of working fluid through the fluid outlet channel 80 (from the wider section front end 81) to the fluid passage 60. The working fluid reservoir 70 provides working fluid to the passage 60. When the thermal bubble in the firing chamber 30 dissipates, the fluidic pressure in the firing chamber 30 is lower than that in the passage 60 so as to suck in working fluid to the firing chamber 30 through the inlet channel 50 (from the wider section front end 51) and to refill working fluid to the firing chamber 30. Here we can notice the characteristics of the fluid flow. As the instant high pressure in the firing chamber 30 occurs, the working fluid in the chamber 30 has a lower resistance to pass through the wider section (front end) 81 of the outlet channel 80 than to pass through the narrower section (rear end) 52 of the inlet channel 50, so that the high pressure working fluid flows outwards through the front end 81, then the rear end 82, to the passage 60. In contrary, as low pressure in the firing chamber occurs, the working fluid in the passage 60 has a lower resistance to pass through the wider section front end 51 of the inlet channel 50 than to pass through the narrower section rear end 82 of the outlet channel 80, so that the working fluid in the passage 60 flows inwards through the front end 51, then the rear end 52, to the chamber 30. The inlet channel 50 and the outlet channel 80 formed on both sides of the firing chamber 30 have a same convergent direction, so that the working fluid enters and exits the firing chamber 30 in a consistent flow direction via separated micro fluid channels 50 and 80. The consistent fluid flow makes the fluid refilling smooth and fast, the system operating frequency therefore can be increased.

As shown in FIG. 3A, the adjacent micro fluidic channel elements 10 have reversed convergent directions of their inlet channels 50 and outlet channels 80, so that the flow directions of the adjacent micro fluidic channel elements 10 are reversed and compositely form an S-shape flow. Further, the activators 40 of the adjacent micro fluidic channel elements 10 of the micro fluidic module are driven with different time sequence that when a micro fluidic channel element 10 ejects, the adjacent ones stay idle. By the aforesaid reversed flow directions and separated operations of adjacent micro fluidic channel elements 10, the cross-talk and interference of adjacent working fluid is prevented.

Figure 3B:
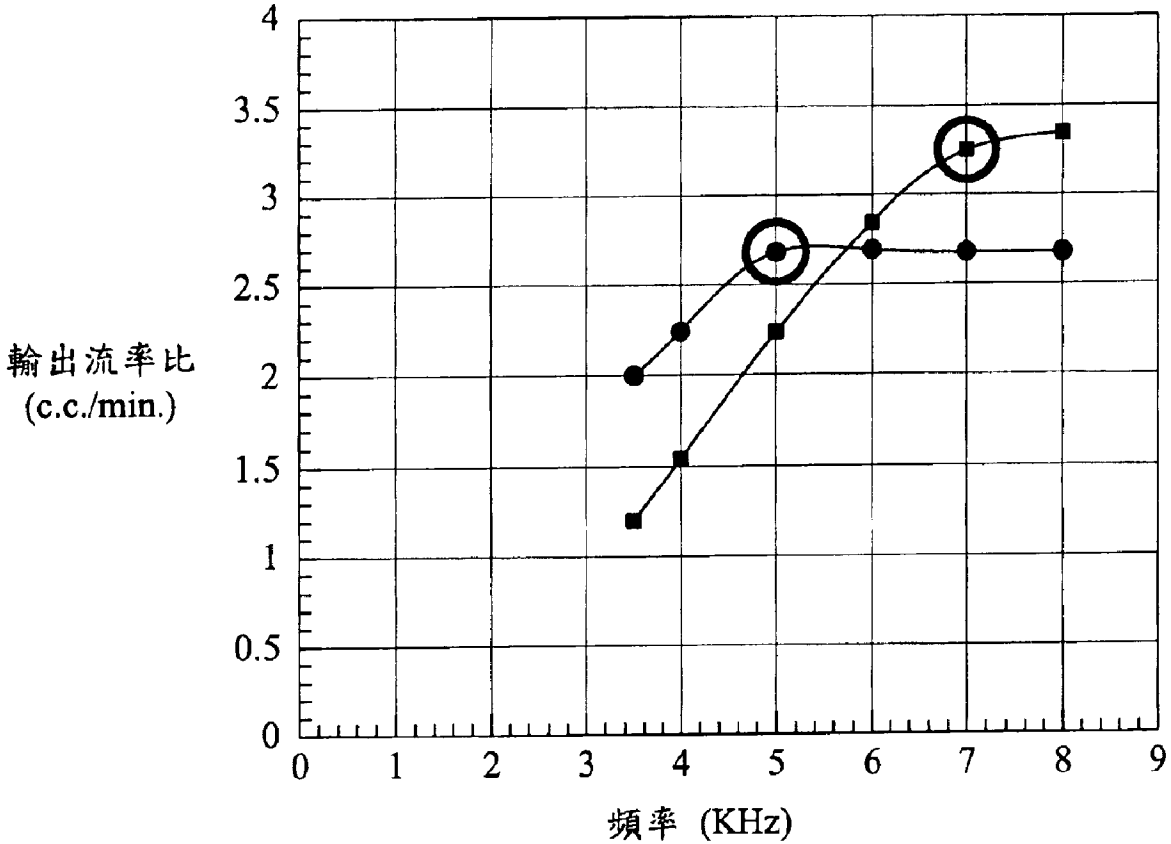
FIG. 3B is a performance diagram of a micro fluid module of the invention in comparison with a conventional one.

FIG. 3B is a performance diagram of a micro fluidic module of the invention in comparison with a conventional one. It shows a stable ejection rate of the working fluid is about 2.7 c.c. per minute at an operating frequency of 5 kHz. Under a same working environment, an embodiment of the invention provides a stable ejection rate of 3.3 c.c. per minute at an operating frequency of 7 kHz. It is clear that a micro fluidic module of the invention can work with a higher frequency operation and provide a higher stable ejection rate of working fluid.

Figure 4:
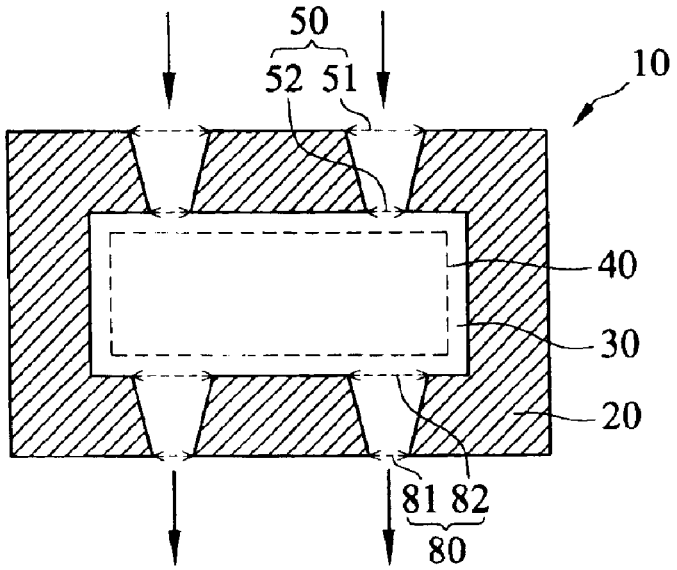
FIG. 4 is a constructional view of a second embodiment of the invention.

In practice, the convergent shapes of the inlet channels 50 and the outlet channels 80, and the number of channels are not limited. Any arrangement that facilitates the working fluid coming through wider section front ends of channels can be used. For example, FIG. 4 shows a second embodiment of the invention. Two sides of the micro fluid channel barrier 20 are formed respectively with two or more convergent fluid inlet channels 50 and two or more convergent fluid outlet channels 80. The multiple outlet channels 80 make the instant high pressure working fluid fast exiting the firing chamber 30. The multiple inlet channels 50 make the lost working fluid in the firing chamber 30 fast refilled from exterior of the channel barrier 20. Therefore, the refilling of working fluid to the firing chamber 30 is easily obtained.

Figure 5:
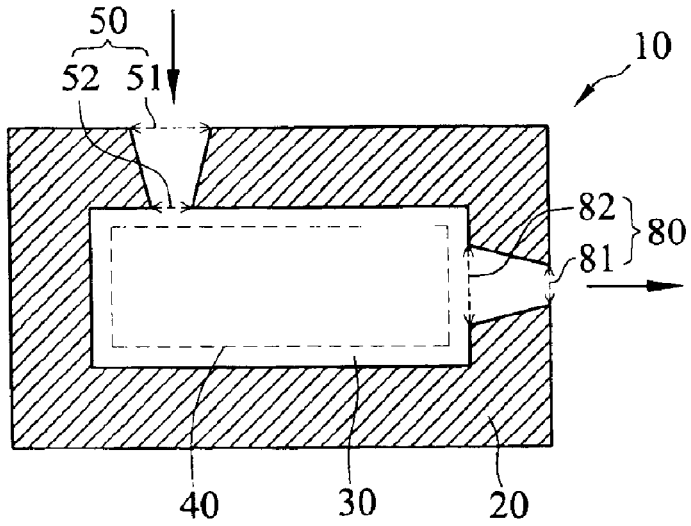
FIG. 5 is a constructional view of a third embodiment of the invention.

Further, the positions of fluid inlet channel 50 and fluid outlet channel 80 of the micro fluidic module are not limited to opposite sides of the micro fluid channel barrier 20. As shown in FIG. 5, a third embodiment of the invention, a convergent inlet channel 50 is formed on one side of the micro fluid channel barrier 20, while a convergent outlet channel 80 is formed on a side adjacent to the inlet channel 50. So that, the flow direction of working fluid can be arranged to meet different requirements and applications.

Figure 6:
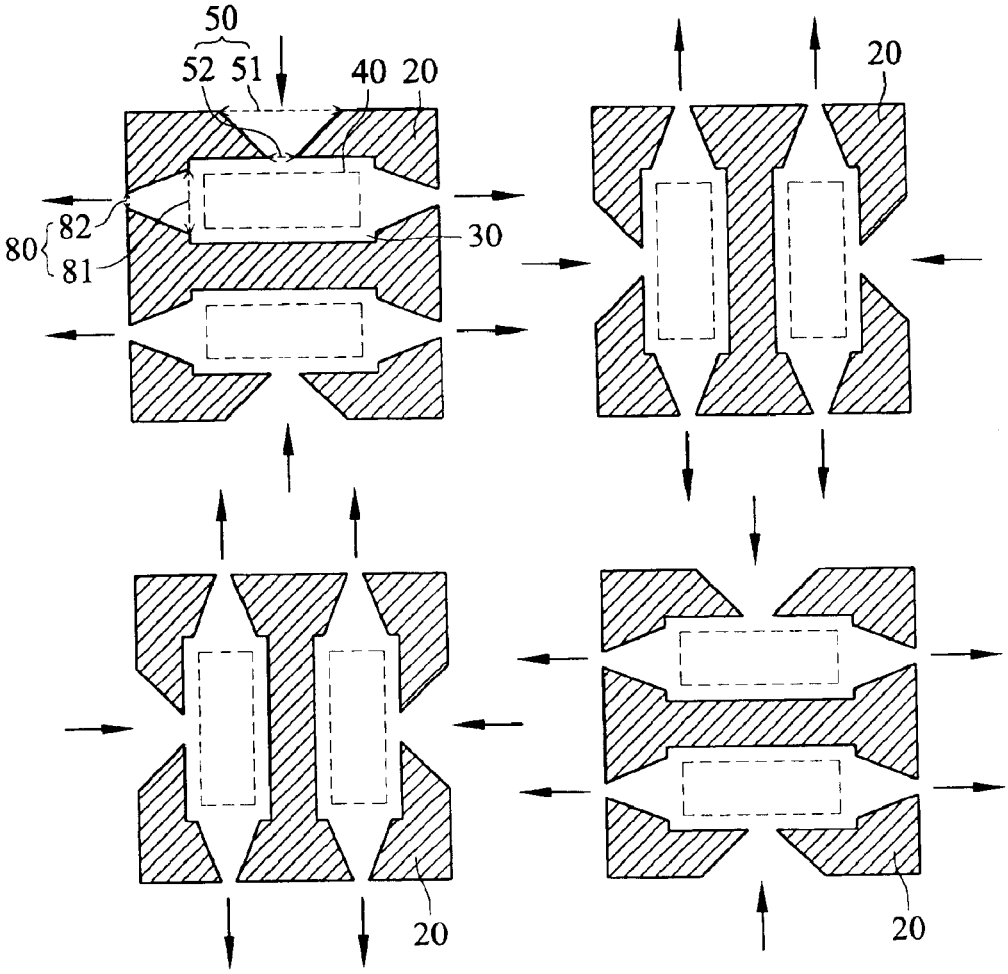
FIG. 6 is a constructional view of a fourth embodiment of the invention.

FIG. 6 shows a fourth embodiment of the invention. The micro fluid module is arranged in a matrix. Each micro fluid channel unit includes two inlet channels 50 connected to two firing chambers 30; and four outlet channels 80 connected to the firing chambers 30 with two for each chamber. Each inlet channel 50 is formed with a larger section 51 on the outer surface of the micro fluid channel barrier 20, and a narrower section on the inner surface of the firing chamber 30 so that the working fluid can easily flow into the chamber 30 when a lower pressure occurs in he chamber 30. On the contrary, each outlet channel 80 is formed with a larger section 81 on the inner surface of the firing chamber 30, and a narrower section on the outer surface of the micro fluid channel barrier 20 so that the working fluid can easily flow outside the chamber 30 when a high pressure generated in he chamber 30 by an actuator 40. The multiple convergent inlet channels 50 and multiple convergent outlet channels 80 make the working flow fast refilled and expelled so as to fast stabilize the fluid level of working fluid in the firing chamber 30.

The matrix arrangement of the micro fluid channel units in the micro fluidic module provides a circulated smooth flow direction of the working fluid.

Figure 7:
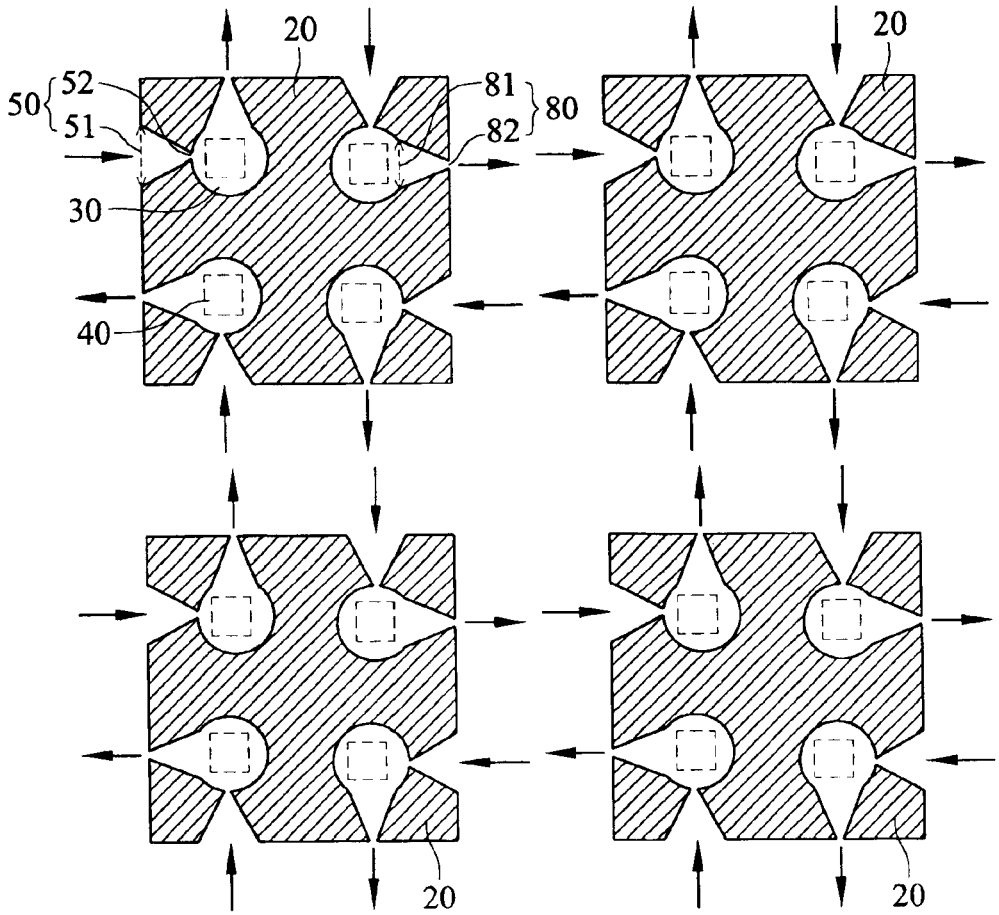
FIG. 7 is a constructional view of a fifth embodiment of the invention.

FIG. 7 shows a fifth embodiment of the invention. The micro inlet channels 50 and the micro outlet channels 80 are also formed with convergent shapes as described above. The difference is that each micro fluid channel barrier 20 is formed with four firing chambers 30; the firing chamber 30 is round that reduces the flowing resistance of working fluid in the firing chamber 30.

Figure 8:
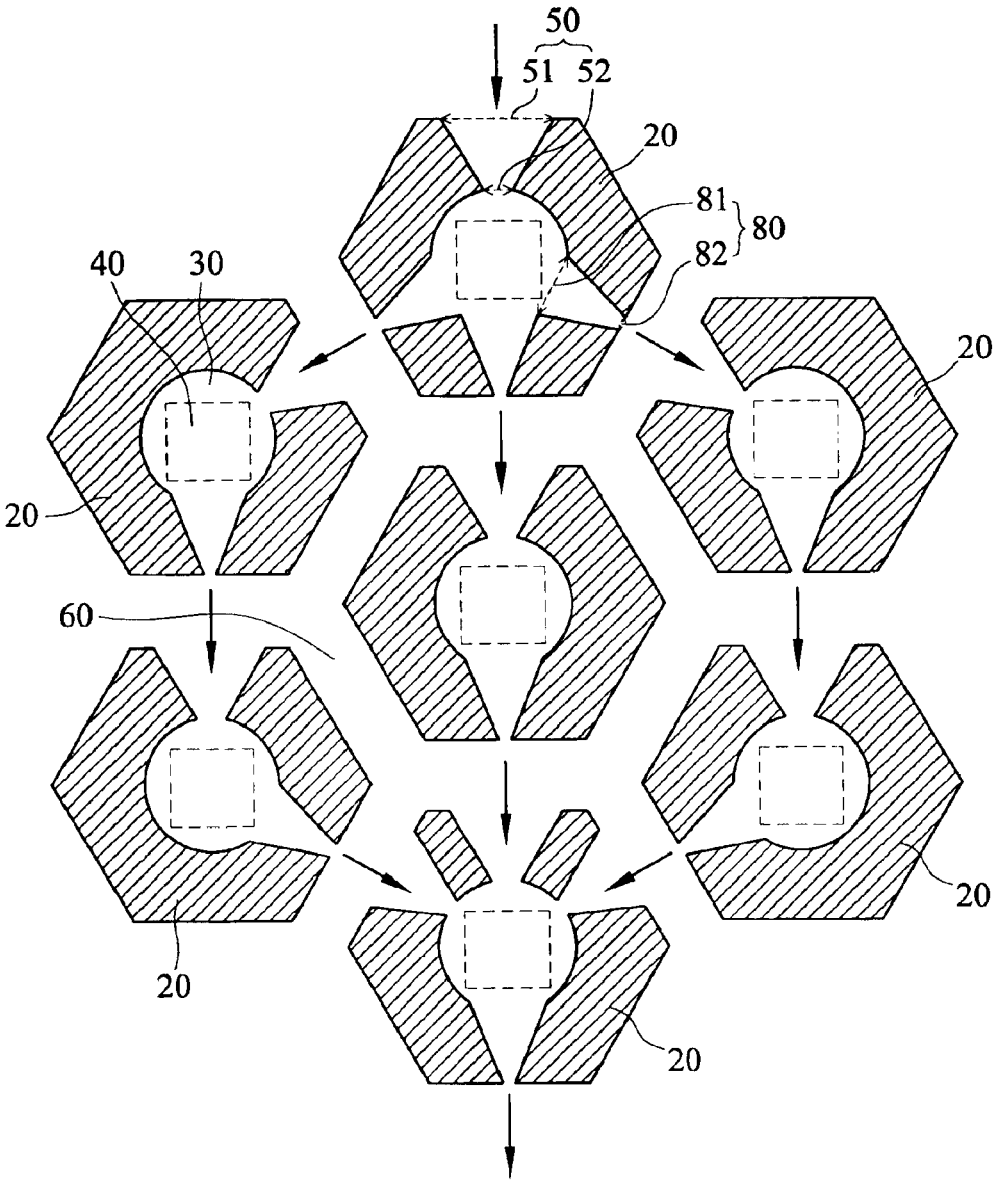
FIG. 8 is a constructional view of a sixth embodiment of the invention.

The shape of micro fluid channel barrier 20 is not limited to square. Any suitable shape can be used. For example, FIG. 8 shows a sixth embodiment of the invention. The micro fluid channel barrier 20 is hexagonal. The micro fluid channel barriers 20 are arranged in a faveolate construction. Passages 60 are formed around the micro fluid channel barriers 20 for working fluid flowing therein. One or more inlet channels 50 and one or more outlet channels 80 are formed on sides of the micro fluid channel barrier 20. As described above, the channels 50 and 80 are of convergent shapes so as to guide working fluid flowing into the firing chambers 30 through the inlet channels 50, and guide working fluid flowing outside the firing chambers 30 through the outlet channels 80. The directions of the inlet channels 50 and outlet channels 80 formed on the hexagonal micro fluid channel barriers 20 are easily arranged so as to control the flowing direction of working fluid and accommodate to different requirements.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A micro fluidic module for guiding a working fluid supplied by a fluid reservoir, comprising:

a micro fluid channel barrier, composed of: a firing chamber formed in said micro fluid channel barrier for storing working fluid to be ejected; a fluid inlet channel connecting exterior of said micro fluid channel barrier to interior of said firing chamber and having a wider section at exterior side of said barrier and a narrower section at interior of said firing chamber; a fluid outlet channel separate from said fluid inlet channel connecting said interior of said firing chamber to exterior of said micro fluid channel barrier and having a wider section at interior of said firing chamber and a narrower section at exterior side of said barrier; and an actuator, mounted in interior of said firing chamber, for providing pressure to said working fluid;

therefore, a part of said working fluid pressurized by said actuator is expelled through said outlet channel from said firing chamber to exterior of said channel barrier; and other working fluid supplied by said fluid reservoir is refilled through said inlet channel from exterior of said channel barrier to said firing chamber.

2. A micro fluidic module according to claim 1 wherein said actuator is a heater, supplied by exterior electrical power, for providing thermal energy to said working fluid in said firing chamber and causing said ejection.

3. A micro fluidic module according to claim 1 wherein said actuator is made of piezoelectric material.

4. A micro fluidic module according to claim 1 wherein said micro fluid channel barrier is a polygonal body.

5. A micro fluidic module according to claim 1 wherein said firing chamber is a polygonal cavity.

6. A micro fluidic module according to claim 1 wherein said micro fluid channel barrier comprises multiple fluid inlet channels for increasing refilling speed of working fluid from exterior of said channel barrier to said firing chamber.

7. A micro fluidic module according to claim 1 wherein said micro fluid channel barrier comprises multiple fluid outlet channels for increasing expelling speed of working fluid from said firing chamber to exterior of said channel barrier.

8. A micro fluidic module according to claim 1 wherein said micro fluid channel barrier comprises a plurality of fluid firing chambers each having at least an inlet channel and at least an outlet channel connecting between said firing chambers and exterior opposite sides of said micro fluid channel barrier.

9. A micro fluidic module according to claim 8 wherein said inlet channel and said outlet channel of each firing chamber have convergent sections to get a one-way consistent fluid flow passing through said firing chamber; said fluid flow for adjacent firing chambers are opposite to each other so as to form an S-shape fluid flow.

10. A micro fluidic module for guiding a working fluid supplied by a fluid reservoir, comprising:

a plurality of micro fluid channel barrier, each composed of: a firing chamber formed in said micro fluid channel barrier for storing working fluid to be ejected; at least a fluid inlet channel connecting exterior of said micro fluid channel barrier to interior of said firing chamber and having a wider section at exterior side of said barrier and a narrower section at interior of said firing chamber; at least a fluid outlet channel separate from said at least a fluid inlet channel connecting said interior of said firing chamber to exterior of said micro fluid channel barrier and having a wider section at interior of said firing chamber and a narrower section at exterior side of said barrier; and a plurality of actuators, each mounted in interior of said firing chamber, for providing pressure to said working fluid;

therefore, parts of said working fluid pressurized by said actuators are expelled through said outlet channels from said firing chambers to exterior of said channel barriers; and other working fluid supplied by said fluid reservoir is refilled through said inlet channels from exterior of said channel barriers to said firing chambers.

11. A micro fluidic module according to claim 10 wherein said actuators are heaters, supplied by exterior electrical power, for providing thermal energy to said working fluid in said firing chambers and causing said ejection.

12. A micro fluidic module according to claim 10 wherein said actuators are made of piezoelectric material.

13. A micro fluidic module according to claim 10 wherein a fluidic outlet channel of a fluidic channel barrier corresponds to a fluid inlet channel of an adjacent fluidic channel barrier.

14. A micro fluidic module according to claim 10 wherein a fluidic inlet channel of a fluidic channel barrier corresponds to a fluid outlet channel of an adjacent fluidic channel barrier.

15. A micro fluidic module according to claim 10 wherein one side of said fluidic channel barrier is formed with said inlet channel and said outlet channel.

16. A micro fluidic module according to claim 10 wherein said micro fluid channel barriers are arranged in a matrix.

17. A micro fluidic module according to claim 10 wherein said micro fluid channel barriers are polygonal bodies.

18. A micro fluidic module according to claim 10 wherein said micro fluid channel barriers are arranged in a faveolate construction.

19. A micro fluidic module according to claim 10 wherein said firing chambers are polygonal cavities.

* * * * *